US007028363B1

(12) United States Patent
Gartner

(10) Patent No.: US 7,028,363 B1
(45) Date of Patent: Apr. 18, 2006

(54) SWIVEL PAD PAINTER

(75) Inventor: Perry Gartner, Englewood, NJ (US)

(73) Assignee: Brenner International, Corp., Englewood, NJ (US)

( * ) Notice: Subject to any disclaimer, the term of this patent is extended or adjusted under 35 U.S.C. 154(b) by 12 days.

(21) Appl. No.: 10/605,619

(22) Filed: Oct. 14, 2003

(51) Int. Cl.
*B05C 17/00* (2006.01)

(52) U.S. Cl. ..... 15/210.1; 15/144.2; 15/145

(58) Field of Classification Search ..... 15/144.1, 15/144.2, 209.1, 210.1, 143.1, 145
See application file for complete search history.

(56) References Cited

U.S. PATENT DOCUMENTS 2,402,577 A * 6/1946 Rodgers ..... 15/210.1
2,764,774 A * 10/1956 Belsky et al ..... 15/228
2,854,683 A * 10/1958 Warden ..... 15/144.2
2,993,222 A * 7/1961 Laymon ..... 15/234
3,214,779 A * 11/1965 Wheeler ..... 15/244.2
3,720,976 A * 3/1973 Bailey ..... 15/244.2
3,737,938 A * 6/1973 Saltzstein ..... 15/231
4,032,239 A * 6/1977 Maupin ..... 401/203
4,475,262 A * 10/1984 Downer ..... 15/210.1
5,410,771 A * 5/1995 Bereza ..... 15/220.1
5,655,250 A * 8/1997 Warrell ..... 15/228
6,341,401 B1 * 1/2002 Lin ..... 15/119.2
2004/0064909 A1 * 4/2004 Locklear ..... 15/160

* cited by examiner

*Primary Examiner*—Randall Chin
(74) *Attorney, Agent, or Firm*—Richard A. Joel, Esq.

(57) ABSTRACT

A painting tool capable of swiveling through 360 degrees comprising a base having a pad mounted thereto and upwardly projecting threaded portion on the base having a recess or socket and a handle having a ball at one end to engage the socket. A threaded nut joins the ball to the socket. A tab may be provided on the base to lock the pad in position. The tool permits an increase in the speed of painting and is particularly effective when an extension pole is mounted to the handle.

2 Claims, 4 Drawing Sheets

SWIVEL PAD PAINTER

BACKGROUND OF INVENTION

The painting tool of this invention is capable of operating in a swivel mode through 360° as well as being locked in a fixed position. The swivel mode permits an increase in speed of painting and is particularly effective when an extension pole is attached to the handle. The painting tool involves but is not restricted to pad painters and spatter guard rollers.

The prior art includes applicators which have a mechanism to move the applicator to another fixed position with regard to the handle or a type of ratchet wherein the applicator can be moved to a number of fixed positions but all in the same vertical plane.

The prior art includes patent publication 2002/0148057 to Hobden which discloses an adjustable handle for a paint pad. The handle can be pivoted a selected number of degrees relative to the pad holder plate and includes a lock sleeve that can be used for locking the handle in selected angular positions relative to the plate.

Patent 4,219,899 to Zurawin discloses a paint support and handle assembly wherein the handle is mounted for swinging movement of about 90°. A spring clip is used for biasing the handle in a given direction.

Also of interest are patents 6,305,043 and 6,073,298. No patents disclose applicant's unique design which swivels through 360° and improves the speed and efficiency of painting.

SUMMARY OF INVENTION

This invention relates to painting tool such as a pad painter which may be operated in a unique swivel mode. The pad painter is marketed under the name WORK FAST by Brenner International Corp. The pad range of motion is extended to 360°. The pad painter comprises a pad affixed to an elongated plastic member or pad plate having channel members along the sides thereof to receive the handle coupling member. The upper coupling member is mounted to the elongated plastic member and includes a centrally located upwardly projecting threaded portion. The threaded portion includes a centrally located socket joint of a hemispherical configuration within the projecting member.

The handle includes an elongated configured upper portion and a curved portion at one end thereof terminating in a slotted ball or sphere. An internally threaded cap having a central aperture is slidably mounted over the curved end portion. The cap is screwed onto the threaded upper coupling member locking the ball within the socket and permitting the ball with the handle to swivel about the socket. The pad painter may swivel at any angle. This swivel mode permits an increase in the speed of painting. A unique tab is also used on the pad painter to facilitate taking a refill on and off.

Accordingly, an object of this invention is to provide a new and improved pad painter.

Another object of this invention is to provide a pad painter wherein the handle may operate in a swivel mode extending the range of motion.

A further object of this invention is to provide a new and improved pad painter or other painting tool wherein the handle may be locked in a fixed position or swivel to any other position within 360°.

A still further object of this invention is to provide a new and improved pad painter having a unique tab arrangement to couple refills to the handle and facilitate changing pads.

A more specific object of this is to provide a new and improved pad painter having a handle with a ball at one end which engages a recessed socket joint on a coupling member to which the pad is mounted to permit operating the pad painter in either a 360° swivel mode or in a fixed position.

BRIEF DESCRIPTION OF DRAWINGS

The above an other object and advantages of the invention may be more clearly seen when viewed in conjunction with the accompanying drawings wherein:

FIG. 3 is an exploded view of an edger trimmer including the invention, and.

DETAILED DESCRIPTION

Figure 1:
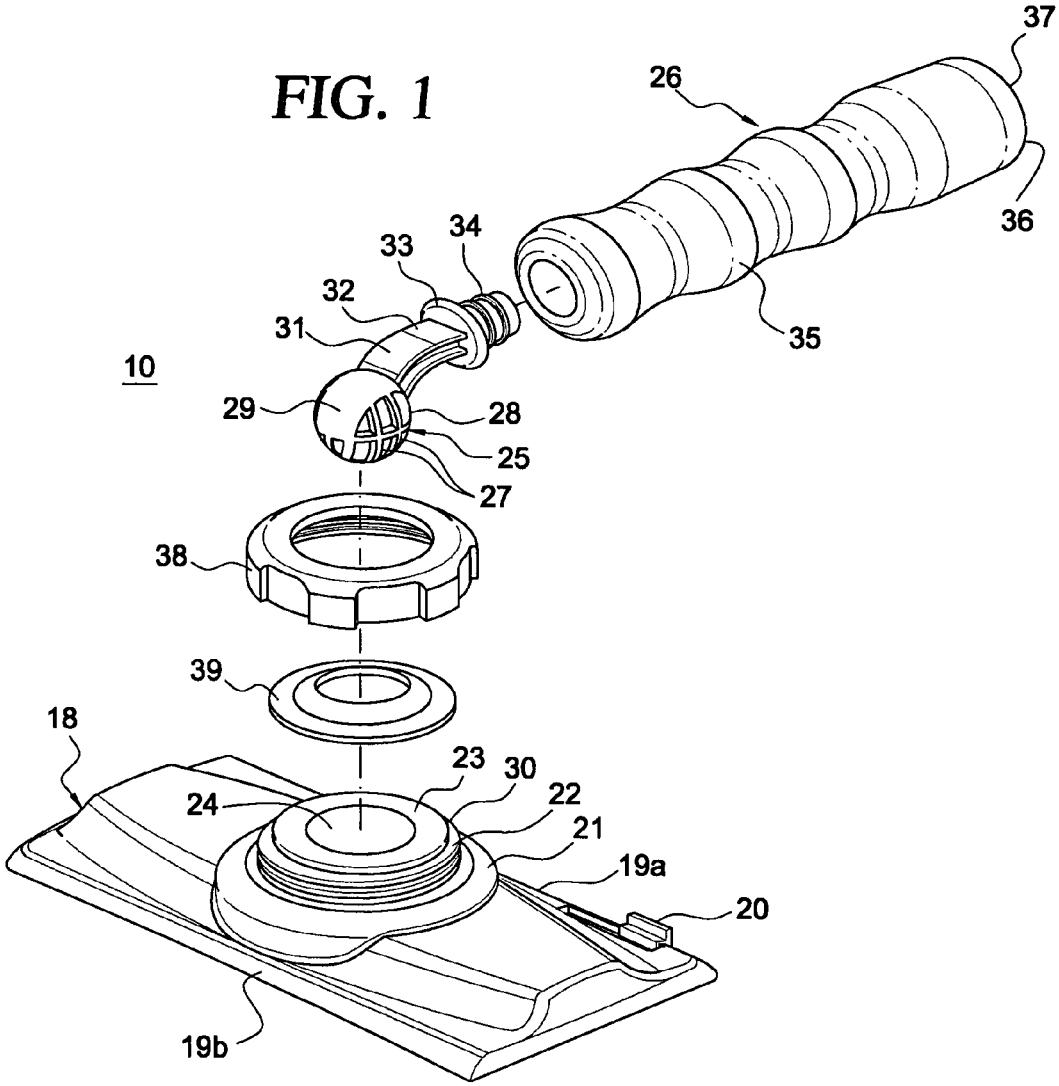
FIG. 1 is an exploded view of the pad painter comprising the invention.
Figure 2:
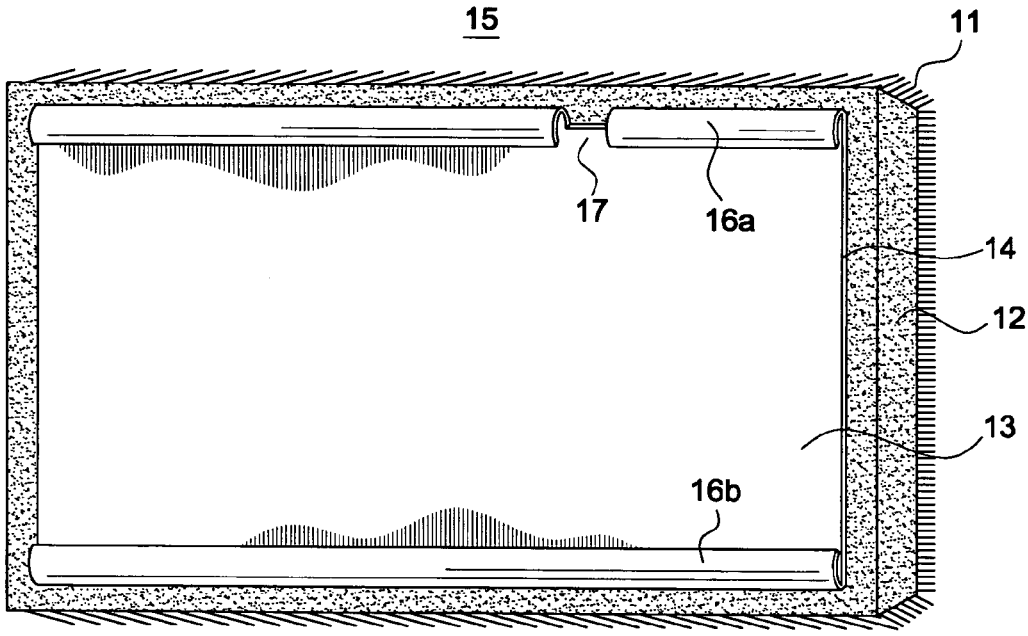
FIG. 2 is a front perspective view of a pad assembly.

A unique pad painter 10, shown in FIG. 1 comprises an elongated woven or fabric pad 11 as shown in FIG. 2, having a sponge-like base 12 secured thereto on one side. A plastic member 13 having channel side portions 16*a*, 16*b* extending upwardly at an angle is mounted to the base 12 with adhesive 14 to form a unitary structure 15. Refills of the pad structure 15 may be mounted to the handle arrangement when appropriate.

One of the side portion, 16*a* includes a cut-away section 17 while the side portions 16*a*, 16*b* basically serve as guides for the handle base or coupling member 18. The member 18 includes tapered edges 19*a*, 19*b* which engage the side portions 16*a*, 16*b* and a tab 20, which is positioned on a cutaway section 17 of side portion 16*a*. The tab 20 engages the cutaway section 17 on the side portion 16 a to lock the pad structure 15 and handle base 18 together.

The handle base structure 18 extends upwardly in the center thereof to form a lower circular portion 21 concentrically located about a circular externally threaded inner portion 22 which extends upwardly therefrom and includes a recess 24. The upper surface 30 includes a plastic layer 23 and a hemispherical recess or socket 24, which engages a ball 25 on the end of the handle 26. The ball 25 includes a plurality of latitudinal slots 27 about the surface thereof, a solid base 28 and a solid portion 29, which is coupled to a curved portion 31 of the handle 26. The curved portion 31 joins a handle portion 32, which extends to flange 33 and then beyond said flange 33 with an enlarged elongated portion 34. A shaped rubber handle cover 35 is mounted over the handle 26. The handle 26 engages portion 34 and terminates at the end portion 36, which includes an internally threaded recess 37 for poles and various extensions.

An internally threaded cap or nut 38 is located and held in place between the flange 33 and the ball 25. The cap 38 includes an internal circular washer 39, which engages the upper surface 30 to lock the pad painter 10 in position as a unit. The cap 38 may be loosened to permit the handle 26 to swivel within a total range of 360°. The swivel mode permits an increase in the speed of painting. This swivel mode is particularly effective with an extension pole attached to the handle 26 at end 36. The fixed mode is used when a precise stroke is required. While described with regard to a pad painter 10, the swivel design may also be employed with spatter guard paint rollers, edgers, etc. A further advantage of the invention mentioned previously is the tab design, which permits rapid replacement of pads 15.

In operation, a pad structure 15 is mounted on the handle by sliding the tapered edges 19*a*, 19*b* of the handle base structure 18 within the channels 16*a*, 16*b*. The tab 20 engages cutaway section 17 to lock the parts 15 and 18 together. A lock tab 20 may be provided at each end. The cap 38 is then threaded onto the externally threaded portion 22 locking the handle ball 25 in recess 24 with washer 39. The ball 25 may be locked in a fixed position or may be permitted to swivel through 360° to speed up painting. This novel approach is nowhere shown in the prior art.

Figure 3:
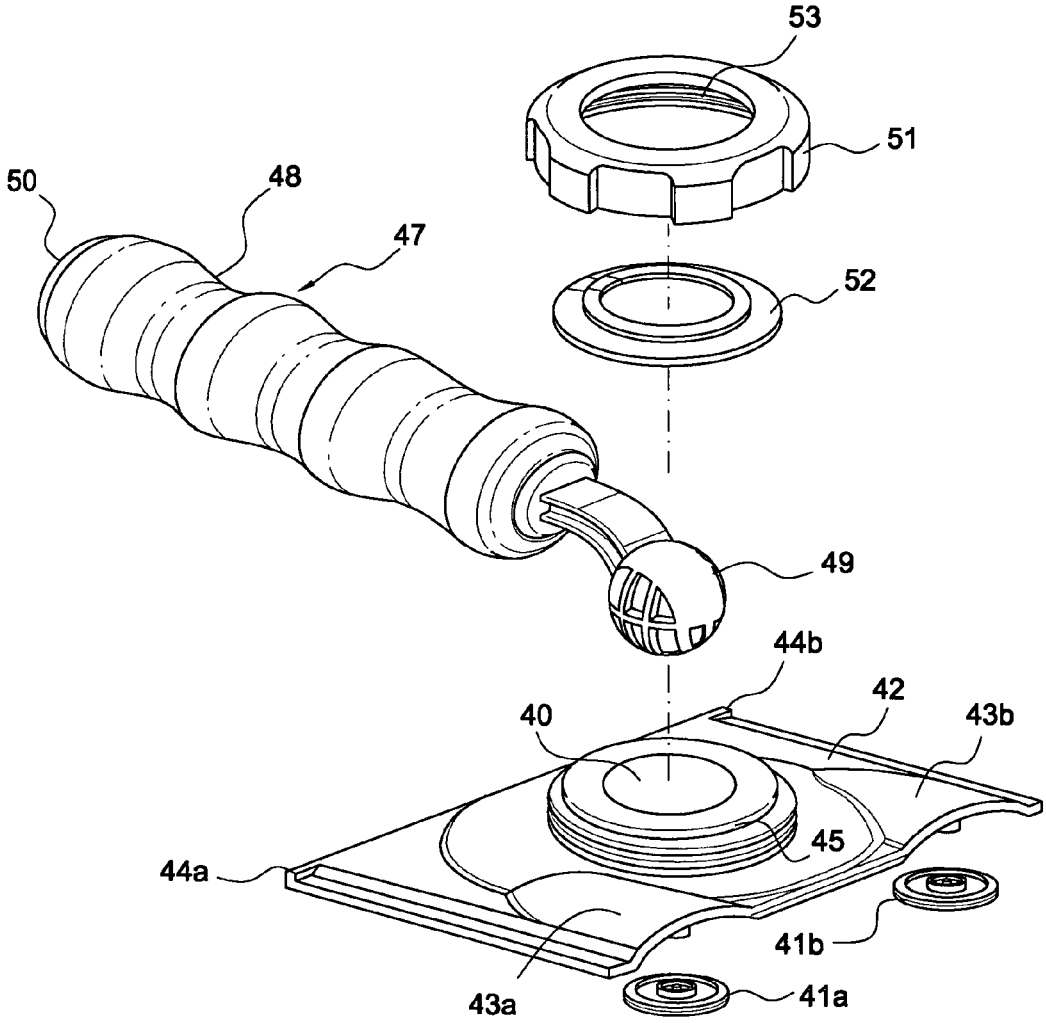
Figure 4:
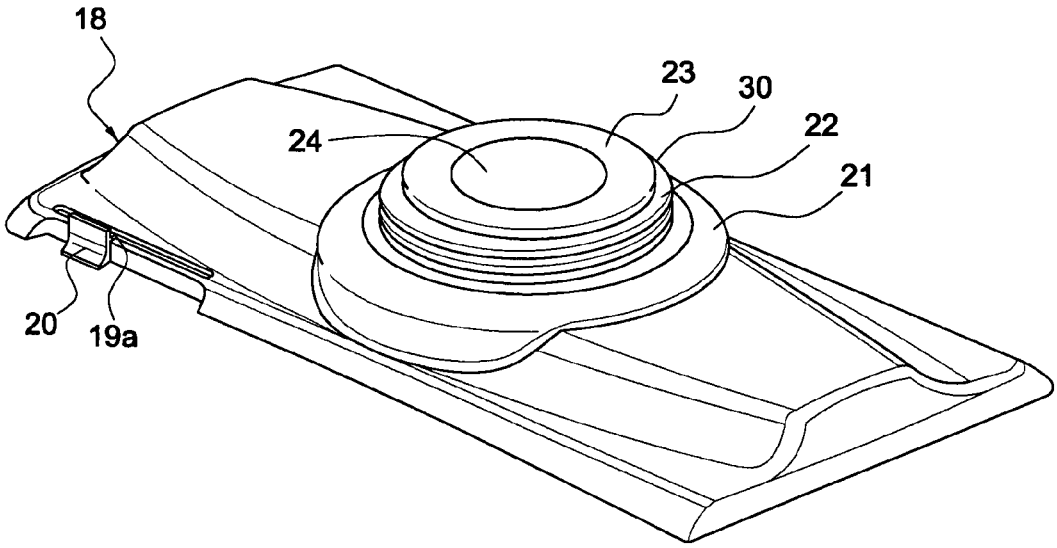
FIG. 4 is a perspective view of the edge trimmer base of the invention.

FIG. 3 discloses an exploded view of an edger trimmer embodiment 40 of the invention. The base 42 however includes a pair of guide wheels 41*a*, 41*b* rotatably mounted to the base 42 within respective curved raised portions 43*a*, 43*b*. Channel portions 44*a*, 44*b* on the sides of the base 42 engage a sponge pad (not shown). As with the preferred embodiment of FIG. 1, the base 42 includes a raised threaded portion 45 having a recessed socket 46. The handle 47 includes a rubber grip 48 at one end plus an internally threaded aperture 50 for extension handles and a slotted ball 49 at the other end. A cap or nut 51 and a washer 52 are mounted over the handle ball 49 to secure the ball 49 within the socket 46 and permit rotation of the base. The threads 53 engage the threads 45 to secure ball 49 in the socket 46.

While the invention has been explained by a detailed description of certain specific embodiments, it is understood that various modifications and substitutions can be made in any of them within the scope of the appended claims, which are intended also to include equivalents of such embodiments.

The invention claimed is:

1. A painting tool comprising:

a flat pad having a paint absorbing portion comprising a first paint engaging side and a second side having an elongated coupling surface mounted thereto;

means mounted to the coupling surface having an upwardly projecting portion including a recessed socket therein;

a handle including a handle portion having a ball at one end to engage the recessed socket, an elongated intermediate portion, and an externally threaded surface at the other end;

mounting means securing ball within the socket to permit rotation of the pad through 360 degrees and permitting the pad to be locked in position; and, the pad comprises an integral elongated body and wherein the coupling surface comprises a rigid substantially rectangular main body having parallel side portions, said side portions each having inwardly and upwardly extending portions forming a channel and one of said side portions having a cutaway section.

2. A painting tool in accordance with claim 1 wherein:

the means mounted to the coupling surface includes an elongated portion having two sides including sloped parallel edge portions, said edge portions slidably engaging the extending side channel portions of the pad coupling surface and further including a tab on one of said edge portions engaging the cutaway section of one side portion to lock the pad to the mounting means.

* * * * *